US005298673A

United States Patent [19]

Iizuka et al.

[11] Patent Number: 5,298,673

[45] Date of Patent: Mar. 29, 1994

[54] ELECRONIC MUSICAL INSTRUMENT USING TIME-SHARED DATA REGISTER

[75] Inventors: Akira Iizuka; Keiji Kawakami, both of Hamamatsu, Japan

[73] Assignee: Yamaha Corporation, Hamamatsu, Japan

[21] Appl. No.: 673,133

[22] Filed: Mar. 20, 1991

[30] Foreign Application Priority Data

Mar. 20, 1990 [JP] Japan ..... 2-70268

[51] Int. Cl.[5] ..... G10H 1/057; G10H 1/06; G10H 1/18; G10H 1/46

[52] U.S. Cl. ..... 84/615; 84/622; 84/627; 84/633

[58] Field of Search ..... 84/622-625, 84/627, 633, 615-620

[56] References Cited

U.S. PATENT DOCUMENTS 4,622,877 11/1986 Strong ..... 84/622 X
5,044,251 9/1991 Matsuda et al. ..... 84/622 X

*Primary Examiner*—Stanley J. Witkowski
*Attorney, Agent, or Firm*—Graham & James

[57] ABSTRACT

An electronic musical instrument for generating musical tone signal including a performance data generating part or generating performance data such as key-on, key-code and key-touch. The instrument also includes a control circuit for generating musical tone control data such as envelope rate data, envelope level data and initial phase data according to the performance data. Further, the control circuit adopts the time-sharing technology for generating plural musical tone signal, so that this instrument is comparatively simple at its circuit configuration compared with the prior art.

9 Claims, 8 Drawing Sheets

| TONE COLOR m | SEG0 | SEG1 | SEG2 | SEG3 | SEG4 | SEG5 |
|---|---|---|---|---|---|---|
| PIANO | LEVEL DATA | LEVEL DATA | LEVEL DATA | LEVEL DATA | LEVEL DATA | LEVEL DATA |
| ORGAN | | | | | | |
| VIOLIN | | | | | | |
| ⋮ | | | | | | |

LEVEL TABLE TBLL

FIG.5(A)

| TONE COLOR m | SEG0 | SEG1 | SEG2 | SEG3 | SEG4 | SEG5 |
|---|---|---|---|---|---|---|
| PIANO | RATE DATA | RATE DATA | RATE DATA | RATE DATA | RATE DATA | RATE DATA |
| ORGAN | | | | | | |
| VIOLIN | | | | | | |
| ⋮ | | | | | | |

RATE TABLE TBLR

FIG.5(B)

ELECRONIC MUSICAL INSTRUMENT USING TIME-SHARED DATA REGISTER

BACKGROUND OF THE INVENTION

1. Field of the Invention

The present invention relates to an electronic musical instrument which is suitable for generating various kinds of sound.

2. Prior Art conventionally, an electronic musical instrument which is based on FM (i.e. frequency modulation) sound technology contains a keyboard, a sound source block, an EG (i.e. envelope generator) block and a sound system, etc., in which a musical tone signal is generated by the sound source block corresponding to key-on operations, then affected by an envelope signal which generated by the EG block, where the envelope signal expansively varies when "segment" information changes. Then, the affected musical tone signal is generated by the sound system as a musical tone.

Further, electronic musical instruments containing microcomputers are recently popularized. However, when the whole electronic musical instrument is consisted with a microcomputer, the processing time of the microcomputer becomes extended, so that real-time musical operation becomes impeded. Consequently, the sound source block and/or the EG block of the conventional electronic musical instrument are constituted with hardware logic circuits. Such circuits have dedicated port registers corresponding to "A" (i.e. attack), "D" (i.e. decay), "S" (i.e. sustain) and "R" (i.e. release) segments (see FIG. 10) respectively, where the registers are controlled by commands from the microcomputer and control the EG block.

According to above-described technology, the conventional electronic musical instruments can carry out realtime music performance without burdening the microcomputer.

However, the prices of high performance and high speed microcomputers are reduced recently, so that such microcomputers are easy to be utilized to electronic musical instruments. By utilizing such high performance microcomputers in electronic musical instruments, satisfactory realtime music performance can be carried out because of their faster processing speed, so that it is needless to have dedicated port registers. Put another way, the conventional electronic musical instruments having dedicated port registers are unnecessarily expensive to manufacture.

SUMMARY OF THE INVENTION

It is accordingly a primary object of the present invention to provide an electronic musical instrument which can be manufactured at lower cost and able to provide out realtime music performance.

In a first aspect of the present invention, there is provided (a) performance data generating means for generating plural types of performance data;

(b) control means for generating plural sort of musical tone control data in accordance with the plural sort of performance data, the control means further generating at least two sort of said musical tone control data by means of time-sharing; and (c) musical tone signal generating means which includes at least two registers for storing musical tone control data generated by the control means, whereby the musical tone signal generating means generate musical tone signal corresponding to the musical tone control data.

BRIEF DESCRIPTION OF THE DRAWINGS

Further objects and advantages of the present invention will be apparent from the following description, reference being made to the accompanying drawings wherein a preferred embodiment of the present invention is clearly shown.

In the drawings:

FIGS. 5(A) and 5(B) show configuration of a level table TBLL and a rate table TBLR;

DESCRIPTION OF THE PREFERRED EMBODIMENT

Next, a preferred embodiment of the present invention will be described.

Figure 1:
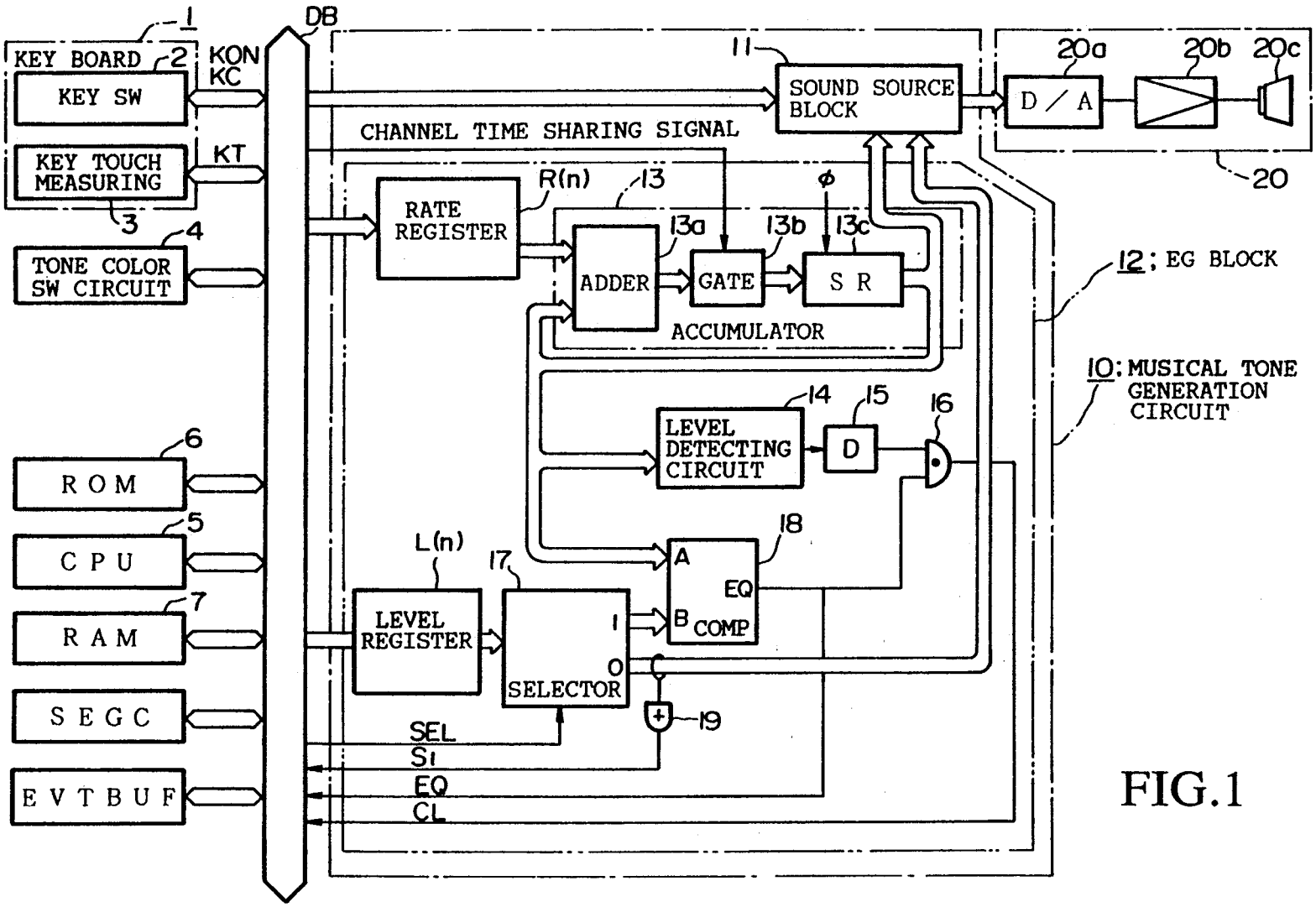
FIG. 1 is an block diagram showing an electronic configuration of a electronic musical instrument according to an embodiment of the present invention.

FIG. 1 is a block diagram showing an electronic configuration of an electronic musical instrument according to an embodiment of the present invention. In FIG. 1, 1 designates a keyboard which contains plural white keys and black keys. Further, each key in the keyboard 1 is fitted with a key switch circuit 2 and a key-touch measuring circuit 3. The key switch circuit 2 detects key-on state of the corresponding key, and when a key is depressed, the key switch circuit 2 outputs a key-on signal KON and a key-code KC of the corresponding key to a data bus DB.

Further, a key touch measuring circuit 3 outputs key touch data KT which represents key speed and key pressure of the depressed key. In general cases, the key touch data KT may be compensated in order to suit the subsequent operation. Further, 4 designates a tone color switch circuit, having plural switches to set the tone color of the musical tone, which transmits the operational status of the switches to the data bus DB. The above-described key-on signal KON, key-code KC and key-touch KT are supplied to a CPU (central processing unit) 5 via the data bus DB.

The CPU 5 supplies various data to a sound generator block 11 (which will be described later) in order to define musical tone parameters according to operation programs previously stored in a ROM (read only memory) 6. Further, the CPU 5 supplies at least two sets of data to an EG block 12 (which will be described later) by the time sharing technology in order to generate envelopes for characterizing the musical tone.

Further, the CPU 5 uses RAM (random access memory) 7 as a working memory, and uses data stored in a segment counter SEGC and in an event buffer register EVETBUF. In addition to the operation programs, the ROM 6 stores a level table TBLL (see FIG. 5(A)), a rate table TBLR (see FIG. 5(B)), and the like.

The rate table TBLR stores rate data for controlling the envelope for every tone color (of "m" tone colors) and for segments SGM arranged in order. The rate data herein represents phase data for envelope. Further, the level data for controlling the envelope is also similarly divided and arranged in the level table TBLL.

Figure 2:
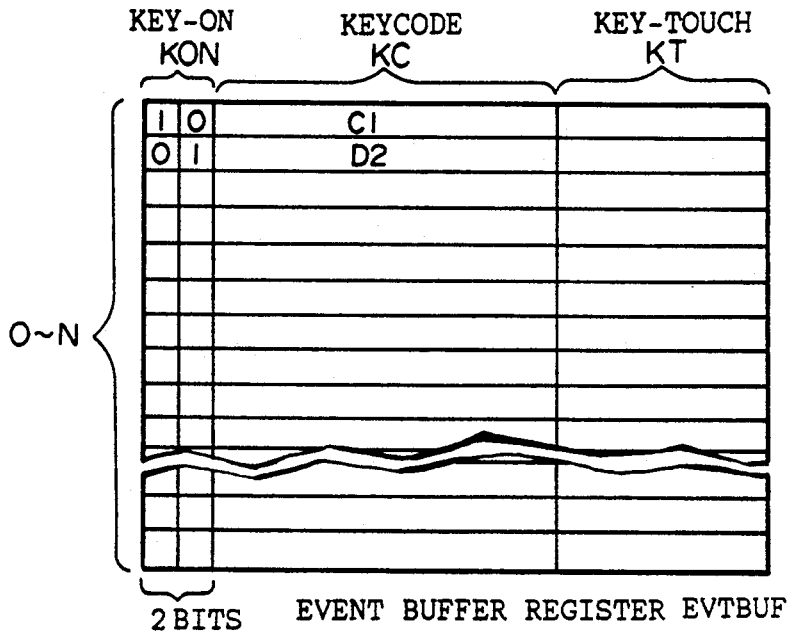
FIG. 2 is a conceptual diagram showing an event buffer register EVTBUF.

The event buffer register EVTBUF stores plural (not to exceed "N") key condition data such as key on/off and the like in due order of their generation as shown in FIG. 2. In FIG. 2, the first two bits indicate key-on KON condition in such manner that "1,0" designates the key-on condition, while "0,1" designates a key-off condition.

The segment counter SEGC consists of "n" number of counters corresponding to "n" of channels (hereinafter, the channel number of "0" to "n" and the like will be expressed as "SEGC(n)" for example), where each counter stores a segment SEG Number (i.e. "1" to "5" in this embodiment).

Figure 3:
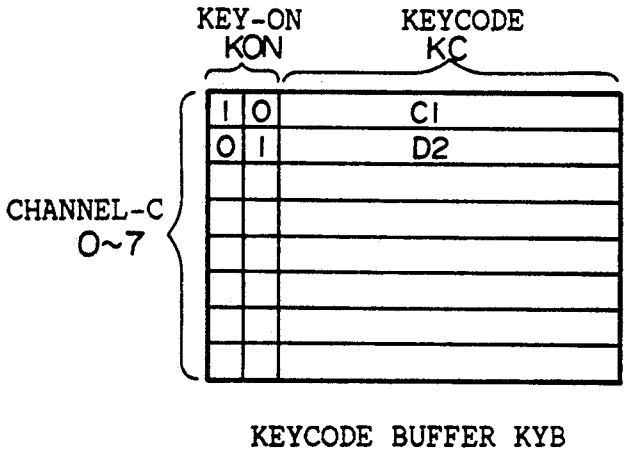
FIG. 3 is a conceptual diagram showing a key-code buffer KYB.
Figure 4:
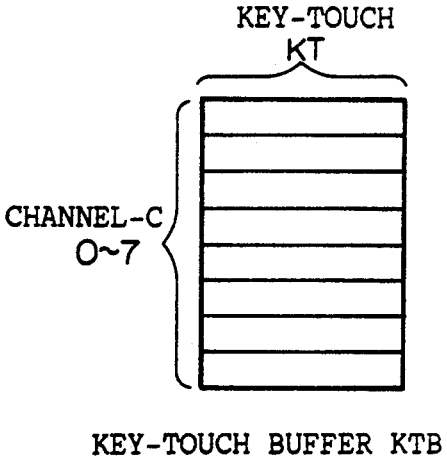
FIG. 4 is a conceptual diagram showing a key-touch buffer KTB.
Figure 6:
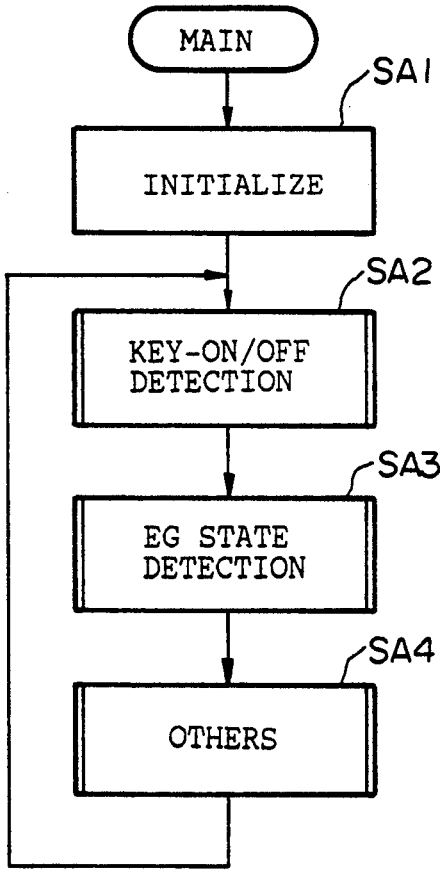
FIG. 6 is a flowchart of main routine used in the embodiment.

Some memory areas in the RAM 7 are assigned to key-code buffer KYB (see FIG. 3), a key-touch buffer KTB (see FIG. 4) and the like. The buffers KYB and KTB store data which are rearranged from the event buffer register EVTBUF.

10 designates a musical tone signal generation circuit, and in this case, utilizes a LSI (large scaled integrated circuit). The circuit 10 contains the sound source block 11 which generates musical tone signal corresponding to various kinds of data and the EG block 12 which generates envelope to affect the musical tone signal generated by the sound source block 11.

The EG block 12 contains a rate registers R(n) where "n" signifies integers of "0" to "7", an accumulator 13, a level detecting circuit 14, a delay circuit 15, an AND circuit 16, a selector 17, a comparator 18 and an OR circuit 19. The rate registers R(n) contains same number of rate registers as the number of channels which store rate data in sequence and then output them to the accumulator 13. The channels are provided for parallel storage of musical tone data corresponding to plural musical tones respectively so as to generate plural musical tones at the same time.

The accumulator 13 contains an adder 13*a*, a gate 13*b* and a shift register 13*c* whereby each of the rate data corresponding to each channel is accumulated based on a time sharing operation synchronizing with a corresponding channel timing respectively. Incidentally, the shift register 13*c* contains the same number of registers as the number of the channels, shifts the rate data in synchronization with a system clock $\phi$, and then outputs current data to the adder 13*a*.

The adder 13*a* adds the current rate data and its accumulated value, and then transmits the addition result to the gate 13*b*. The gate 13*b* outputs the addition result to the shift register 13*c* synchronizing with a channel time sharing signal. Further, the accumulated data in the shift register 13*c* is also supplied to the sound source block 11, to the level detecting circuit 14 and to an comparator 18.

The level detecting circuit 14 detects whether the accumulated data reaches a predetermined value (i.e. "0" in this embodiment) or not. When the accumulated data has reached the predetermined value, the circuit 14 outputs a signal to the delay circuit 15, which outputs signal to an input terminal of the AND circuit 16, after a predetermined delay time.

The level register L(n), containing same number of registers as the number of channels, behaves as similar to the rate register R(n); it fetches level data supplied in sequence, then outputs the data to the selector 17 in the same sequence. Further, the level register L(n) is also used by the CPU 5 when the CPU 5 supplies an initial phase data to the sound source block 11. The initial phase data corresponding to the key-code KC is an initial parameter of musical tone to be required to generate the musical tone by a FM (frequency modulation) sound source such as the sound source block 11. In addition, the initial phase data is a parameter from which the phase data increases in accordance with increasing rate of phase data. The details of the initial phase data is described in Japanese Patent Publication No. 63-42277 for example.

The selector 17 outputs the level data or the initial phase data to the comparator 18 when a select signal SEL is set to "1" level, and to sound block 11 when the select signal SEL is set to "0" level. Further, OR circuit 19 outputs a return signal S1 to the data bus DB when both the select signal SEL is set to "0" level and the current data is supplied to the sound source block 11 in order to indicate the current data is being fed to the block 11.

The comparator 18 which compares the accumulated data with the level data, then outputs an equal signal EQ to the data bus DB and to the AND circuit 16 when the two data coincide. The AND circuit 16 carries out an AND operation to the detecting signal supplied via the delay circuit 15 with the equal signal EQ, and only if both signals are at "1" level, then the circuit 15 outputs a clear signal CL to the data bus DB.

As described above, the sound source block 11 containing a FM sound source transmits musical tone data to a sound system 20 in accordance with the frequency data, the accumulated rate data and the initial phase data. The sound system 20 contains a D/A (digital-/analog) circuit 20*a*, an amplifier 20*b*, and a speaker 20*c*. The D/A circuit 20*a* converts the digitized musical tone data to an analog musical tone signal. The analog musical tone signal is amplified via the amplifier 20*b* and then reproduced by the speaker 20*c* as a musical tone.

Figure 9:
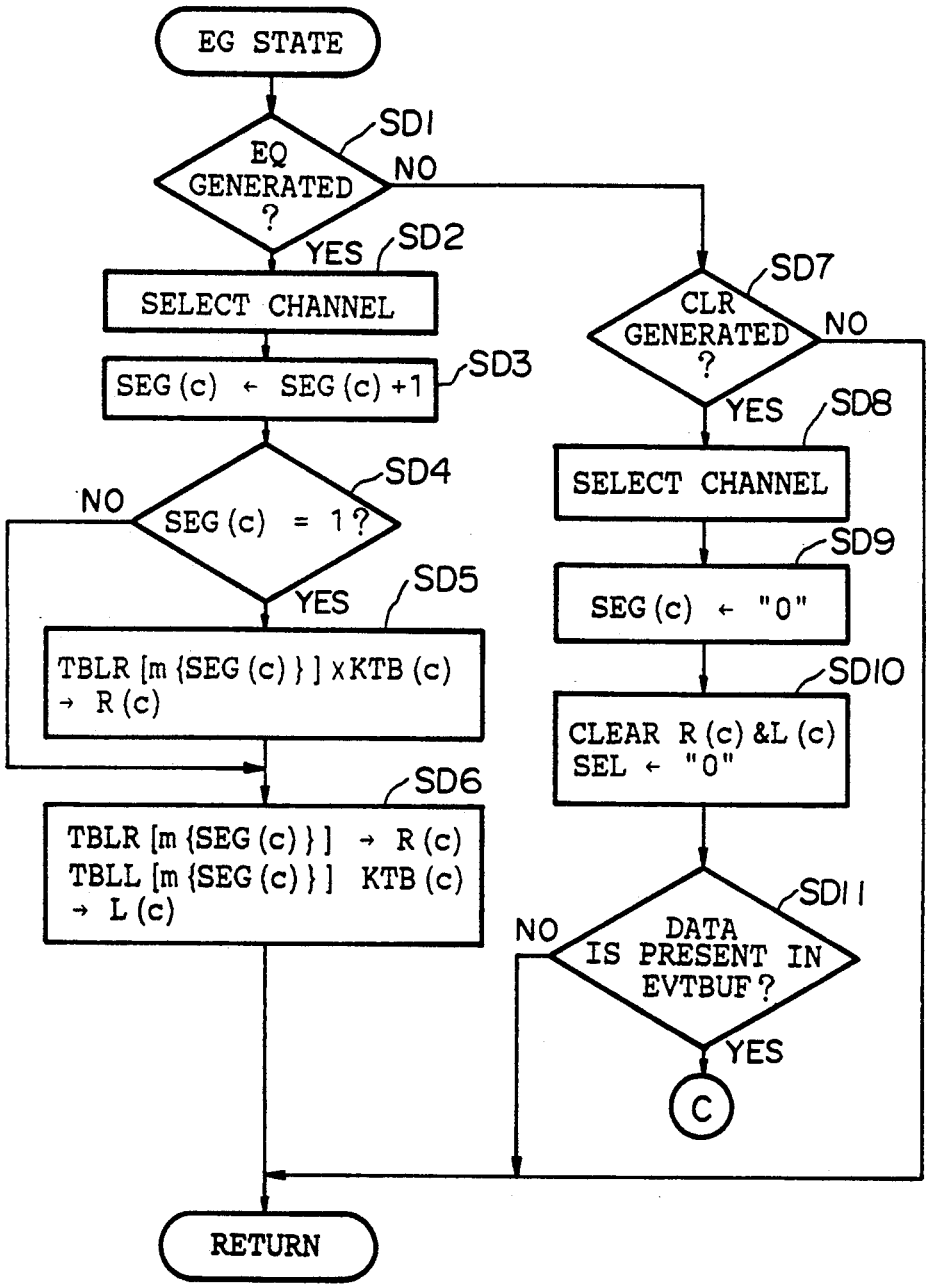
FIG. 9 is a flowchart of the EG-state detecting subroutine used in the embodiment.
Figure 10:
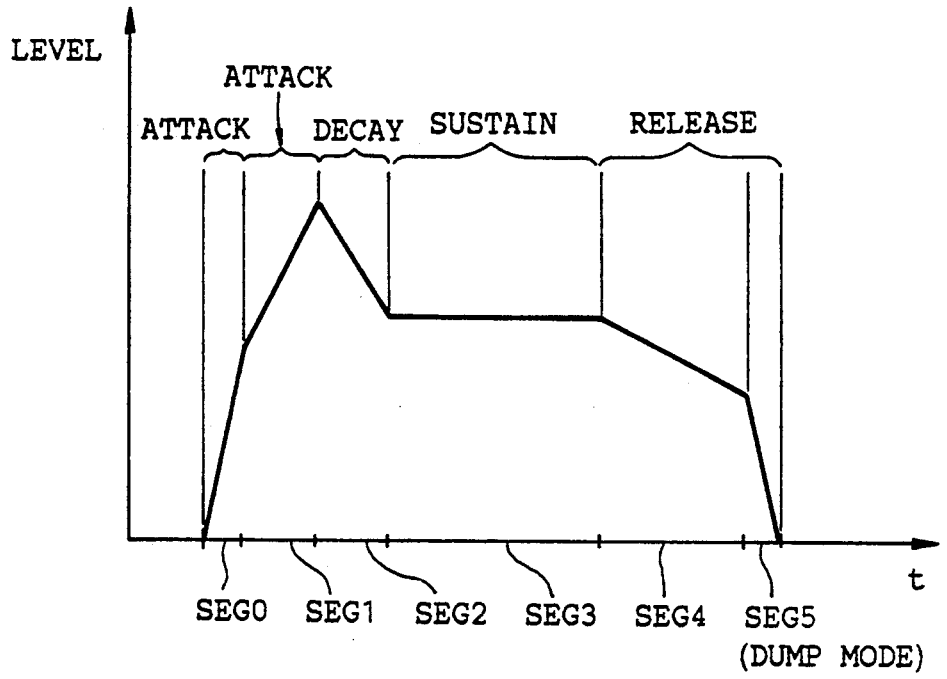
FIG.10 (PRIOR ART)
FIG. 10 is a conceptual diagram showing a waveform of an envelope signal in the embodiment.

Hereinafter, description will be made to an operation of this embodiment along with flow-charts in FIGS. 6 to 9 and the waveform as shown in FIG. 10.

Figure 7:
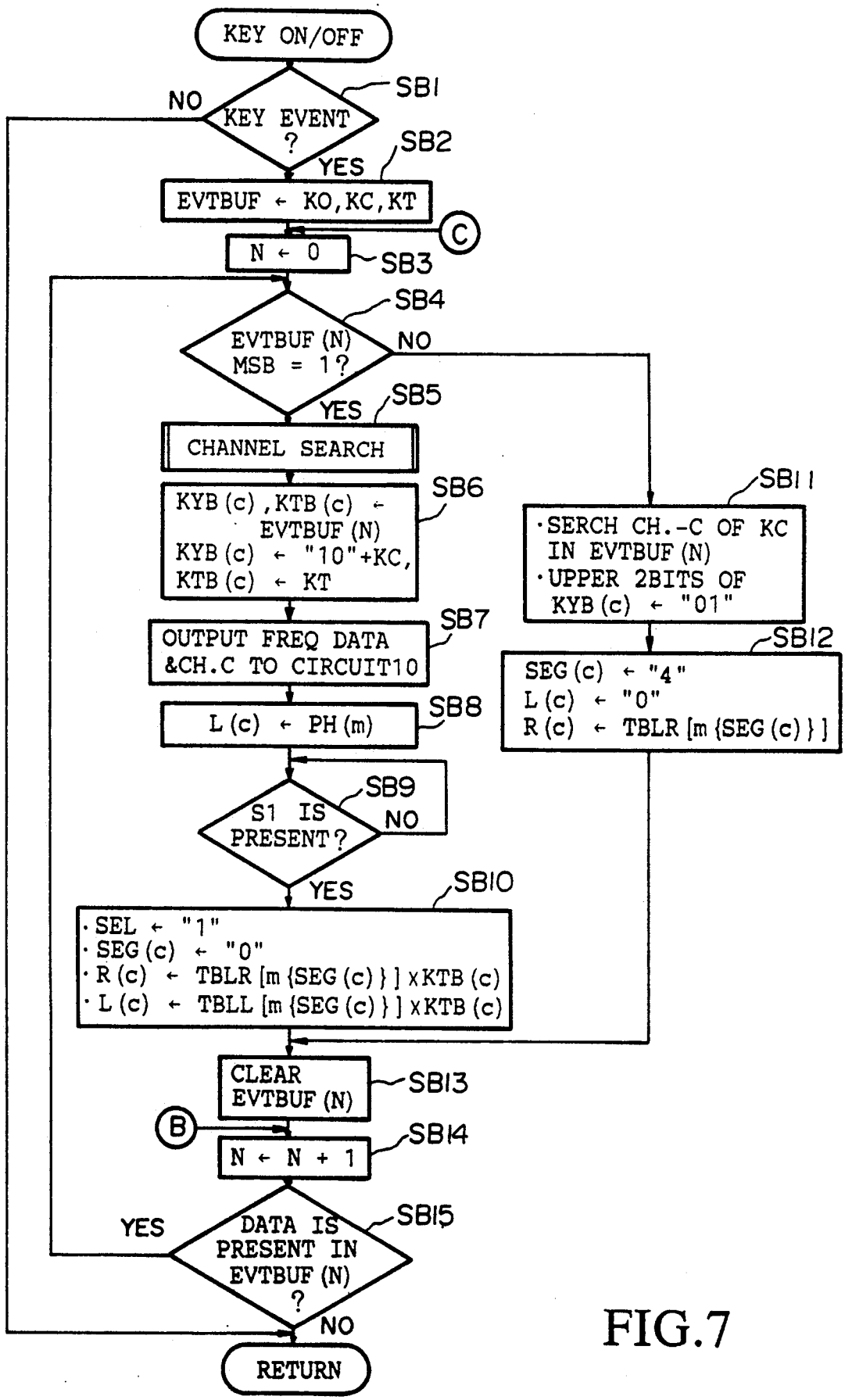
FIG. 7 is a flowchart of key-on/off detecting subroutine used in the embodiment.

First of all, when the circuits shown in FIG. 1 are powered by a certain power supply (not shown), a main routine of operation program (see FIG. 6) is operated by the CPU 5. In step SA1, various parameters, etc. are initialized. The process then moves to step SA2 where a key on/off detecting operation as shown in FIG. 7 is operated.

KEY ON/OFF DETECTING OPERATION

The key on/off detecting operation aims at detecting the key-on and key-off of the keyboard 1, generating the envelope of key-on state corresponding to the segment SEGO (see "SEGO" in FIG. 10) and generating the envelope of key-off state corresponding to the segment SEG4 (see "SEG4" in FIG. 10).

In step SB1, the CPU 5 judges whether a key event (i.e. key-on or key-off) has occurred or not. When no key event occurs, the CPU 5 judges "no" so that process then returns to the main routine. In contrast, when any key event occurs, the CPU 5 judges "yes" so that process then moves to step SB2.

In step SB2, key-on KON, key-code KC and key-touch KT corresponding to all the event key are transferred to unoccupied areas in the key event buffer EVTBUF (see FIG. 2). Then, process moves to step SB3 where a variable N is set to "0". The variable N is used to count the event buffer register EVTBUF. Then, process moves to step SB4.

In step SB4, the CPU 5 judges whether a MSB (i.e. most superior bit) of the event buffer register EVTBUF is "1" or not. That is, the CPU 5 judges whether the key event is key-on or key-off according to the MSB of EVTBUF. If the key event at N=0 is key-on, the CPU 5 judges "yes" so that process moves to step SB5. In step SB5, a channel search operation as shown in FIG. 8 is carried out.

CHANNEL SEARCH OPERATION

Figure 8:
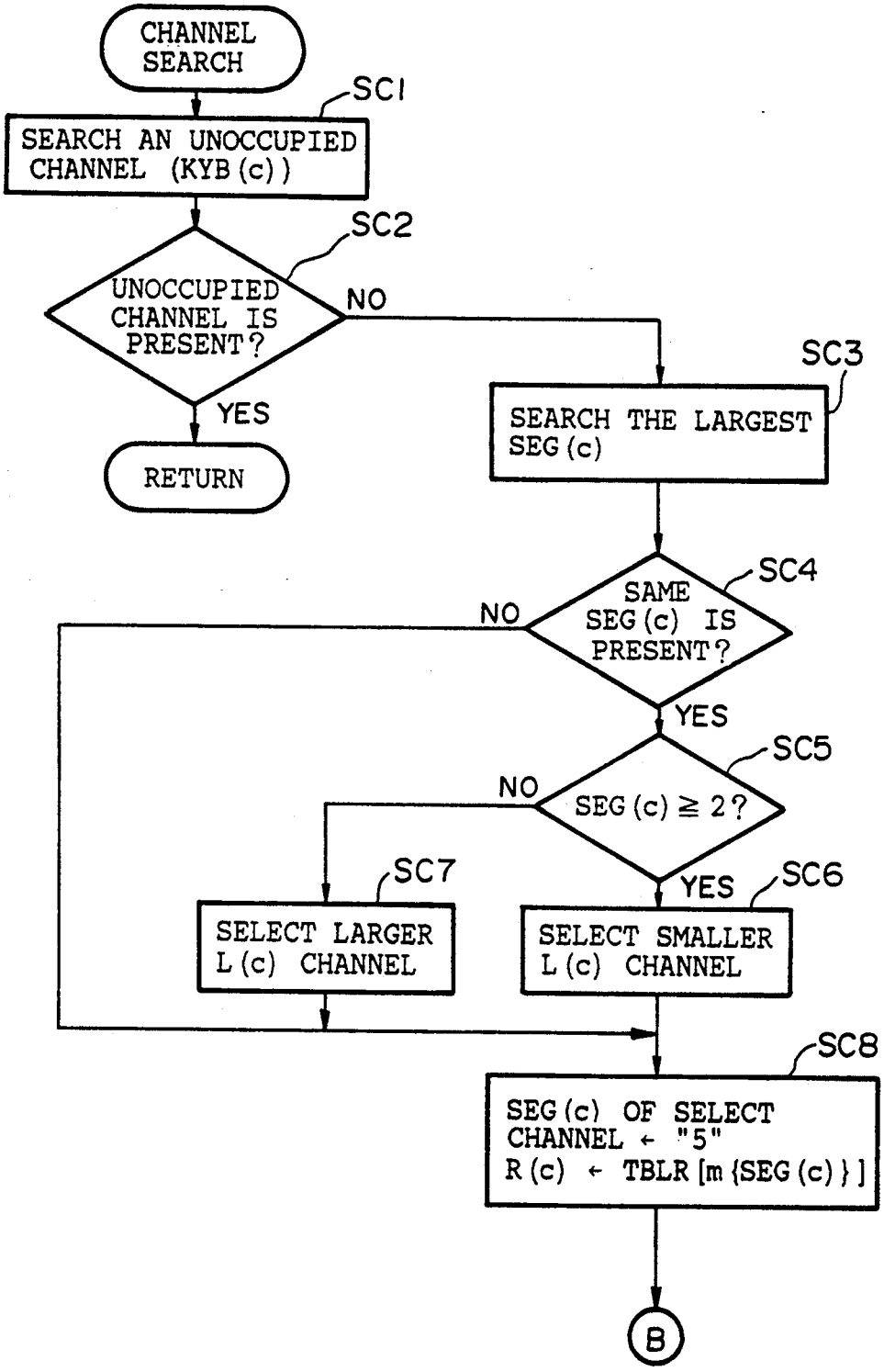
FIG. 8 is a flowchart of the channel search subroutine used in the embodiment.

In FIG. 8, process moves to step SC1 where the CPU 5 searches the key-code buffer KYB (0) to KYB (7) in order to identify if an unoccupied channel is present in the buffer. Then, process moves to step SC2, where the CPU 5 judges whether the unoccupied channel is present or not. If unoccupied channel is presents, the CPU 5 judges "yes" so that process returns to step SB6 in FIG. 7. Hereinafter, the unoccupied channel will be called "channel-C".

KEY ON/OFF DETECTING OPERATION

In step SB6, the data in the event buffer EVTBUF(N) (N=0 in this case) is transferred to a key-code buffer KTB(C) and a key-touch buffer KTB(C) each corresponding to the channel-C. As described above, the key event is key-on in this case, so that the data "1,0" and the key-code KC are transferred to the key-code buffer KYB(C). Further, the key touch KT is transferred to the key touch buffer KTB(C).

In step SB7, a frequency data corresponding to the key-code KC in the KYB (C) and a information of the unoccupied channel being channel-C are transferred to the musical tone generation circuit 10. Then, process moves to step SB8. In step SB8, an initial phase data PH(m) (where "m" is a integer corresponding to the type of musical tone such as a piano and the like) is transferred to the level register L(C), then the data PH(m) is supplied to the selector 17.

In the present case, the select signal SEL was initialized to "0" level, so that the selector 17 outputs the data PH(m) to the sound source block 11 via an output terminal "0". Accordingly, the OR circuit 19 detects that a certain data (i.e. PH(m)) is outputted, and then outputs the return signal S1. Then, the return signal S1 is detected by the CPU 5, hence the process moves to step 10.

In step SB10, the CPU 5 sets the select signal SEL to "1" level, so that the output signal of the selector 17 is supplied to the input terminal B of the comparator 18. Then, the CPU 5 sets the segment counter SEGC(C) to "0". Then, rate data in the rate table TBLR[m{SEG(C)}] is multiplied by the data in KTB(C) and the multiplication result is transferred to the rate register R(C). In other words, the rate data corresponding to tone color "m" and segment SEG of the channel-C is modified by the key-touch data KT of the channel-C, and then transferred to the rate register R(C).

Further, level data in the level table TBLL[m{SEG(C)}] is multiplied by the data in KTB(C) and the multiplication result is transferred to the level register L(C). In other words, the level data is modified by the key-touch data KT and then transferred to the level register L(C), similar to the above-described rate register R(C).

The rate data supplied to the rate register R(C) is further supplied to the accumulator 13 where the rate data is accumulated. Further, the level data supplied to the level data register L(C) is supplied to the comparator 18 via the selector 17. Then, the accumulated rate data is supplied to the sound source block 11, where musical tone data is generated according to the frequency data, the initial phase data and the accumulated rate data. Then, the musical tone data is reproduced by the sound system 20 as musical tone.

Then, process moves to step SB13 where the event buffer EVTBUF(N) is cleared. Then, process moves to step SB14.

In contrast, going back to FIG. 8, if the judgement in the step SC2 is "NO", process moves to step SC3, in which a channel corresponding to the largest segment count (i.e. data in segment counter SEGC(n)) is searched. Then, process moves to step SC4 where the CPU 5 examines whether a channel corresponding to a segment count (i.e. data in segment counter SEGC(C)) which equals to the largest segment count is present or not.

If the CPU 5 judges "YES", process then moves to step SC5. In step SC5, CPU 5 judges if the segment count of the SEGC(C) is larger than "2" or not. The segment count of the SEGC(C) being larger than "2" means that the segment SEG finished the attack segment (see FIG. 10, especially for the decay segment therein). If the judgement in step SC1 is "YES" (i.e., the segment count of SEGC(C) is larger than "2"), in other words, the segment count has reached to the decay segment, process moves to step SC6.

In step SC6, the channel having its level (i.e. the data in the level register L(C)) at the minimum is selected between the channels which are searched in the preceding steps SC3 and SC4.

In contrast, if the judgement in the step SC5 is "NO", in other words, the data in the segment counter SEGC(C) is less than "2" so that the segment SEG remains in the attack segment (see the attack segment in FIG. 10), process then moves to step SC7 where the channel having its level (i.e. the data in the level register L(C)) at maximum is selected between the channels which are searched in the preceding steps SC3 and SC4.

If the preceding steps SC6 & SC7 has been finished or the judgement in the step SC4 is "NO" (i.e. there is only one channel in which its corresponding segment count is the largest), process moves to step SC8. In step SC8, the segment counter SEGC(C) corresponding to the selected channel is set to "5" which designates a sharp-dump mode. It is because the fifth segment SEG in the level table TBLR is storing rate data which cause the musical tone signal to dump rapidly. Then, the CPU 5 supplies data of rate table TBLR[m{SEG(C)}] to the rate register R(C) and supplies "0" data to the level register L(C).

As described heretofore, if there is no unoccupied channel existing, the CPU 5 forcibly sets a certain channel to the final segment SEG in order to close the channel. Accordingly, the certain channel becomes the unoccupied channel. Then, process moves to step SB14.

In step SB14, the variable N is incremented, then process moves to step SB15 where the CPU 5 judges whether next data is present in the event buffer EVTBUF(N) or not. If the judgement in step SB15 is "YES" (i.e. the next data is present in the event buffer EVTBUF(N)), then process moves to step SB4 whereby the CPU 5 judges whether the next key event is key-on or key-off. If the judgement in step SB4 is "YES", the processes from step SB5 to SB15 will be carried out according to the next key event.

KEY-OFF OPERATION

In contrast, if the judgement in the step SB4 is "NO" (i.e. key-off), then process moves to step SB11. In step SB11, the CPU 5 searches the event buffer EVTBUF(N) to find the channel-C which is assigned to the key-code KC. Then, the CPU 5 sets upper two bits of the key-code buffer KYB(C) corresponding to the channel-C to "0,1". Then, process moves to step SB12 where the segment counter SEGC(C) is set to "4", further, the level data (i.e. a target value) in the level register L(C) is set to "0".

The above described operation where the segment counter SEGC(C) is set to "4" means that the musical tone is set to the release area (see FIG. 10) so that the level of the musical tone is being attenuated slowly. Further, data in the rate table TBLR[m{SEG(C)}] is supplied to the rate register R(C).

By the process described above, the musical tone data generated by the sound source block 11 is attenuated slowly.

Then, process moves to step SB13 wherein the similar operation as the key-on event is carried out in the steps SB13 to SB16.

In contrast, if no next data is present in the event buffer EVTBUF(N), the judgement in the step SB15 becomes "NO", whereby process returns to step SA3 in the main routine, so that the key-on/off detecting operation is finished.

In the step SB3, an EG-state detecting operation shown in FIG. 9 is carried out as following.

EG-STATE DETECTING OPERATION

The EG-state detecting operation is aim at carrying out certain processes at each segment SEG or at the end of the musical tone generation.

The comparator 18 shown in FIG. 1 compares the accumulated rate data with the level data corresponding to each channel during the envelope of the musical tone is generated. When the accumulated rate data becomes equal to the level data, the comparator 18 generates the equal signal EQ. Further, when the accumulated rate data equals "0", the level detecting circuit 14 generates "1" signal to the AND circuit 16. Hence, if both the accumulated rate data is equal to the level data and the accumulated data is equals to "0", the AND circuit 16 generates a clear signal CL.

In step SD1, the CPU 5 judges whether the equal signal EQ is generated by the comparator 18 or not. When the judgement is "YES", then process moves to step SD2. In step SD2, the CPU 5 searches the channel-C which corresponding to the current equal signal EQ. Then, process moves to step SD3 where the segment counter SEGC(C) corresponding to the channel-C is incremented. Then, process moves to step SD4 where the CPU 5 judges whether the data in the counter SEGC(C) becomes "1" or not, that is, the CPU 5 detects if the equal signal EQ is generated for the first time or not.

If the judgement in the step SD4 is "YES" (i.e. the equal signal EQ is generated for the first time, in the attack stage), process moves to step SD5. In step SD5, the data in the rate table TBLR[m{SEG(C)}] is multiplied by the data in KTB(C), then its multiplication result is supplied to the rate register R(C). As described before, the rate data corresponding to the segment SEG1 (see FIG. 10) is modified by the key-touch KT and then supplied to the rate register R(C).

In contrast, if the judgement in step SD4 is "NO", or the preceding step SD5 is completed, then process moves to step SD6. In process SD6, data in the rate table TBLR[m{SEG(C)}] is supplied to the rate register R(C), further, the data in level table TBLL[m{SEG(C)}] is multiplied by the data in KTB(C), then its multiplication result is supplied to the level register L(C). Accordingly, the CPU 5 outputs the rate data and the level data, each modified by the key-touch data KT and corresponding to the segments SEG2 to SEG5.

In contrast, if the judgement in the step SD1 is "NO" (i.e., the equal signal EQ is not generated), process moves to step SD7. In step SD7, the CPU 5 judges whether the clear signal CL is outputted by the AND circuit 16 or not. If the CPU 5 judges "NO" (i.e., musical tone data in all the channels have not been finished), then process returns to the main routine.

In contrast, if the judgement in the step SD7 is "YES" (i.e., the clear signal CL has been generated), process moves to step SD8 where the channel-C corresponding to the current clear signal is searched. Then, process moves to step SD9 where the segment counter SEGC(C) corresponding to the channel-C is set to "0". Then, in step SD10, the rate register R(C) and the level register L(C) corresponding to the channel-C are cleared. Further, the CPU 5 sets the select signal SEL to "0" level. Then, process moves to step SD11.

In step SD11, CPU 5 judges whether certain data is present in the event buffer EVTBUF or not. If the CPU 5 judges "NO", then process returns to the main routine. Accordingly, when the musical tone generation corresponding to the channel-C is finished, the CPU 5 clears the corresponding rate registers R(C) and L(C).

In contrast, if the judgement in the step SD11 is "YES" (i.e., next data is present in the event buffer EVTBUF), then process moves to preceding step SB3 (see FIG. 7), whereby the steps SB3 to SB15 are carried out.

Then, when the steps SD3, SD7 or SD11 are finished, then process returns to the step SA4 in the main routine where a sound selection operation according to the tone color switches, parameter setting for the segments "A", "D", "S" & "R" and other necessary operations are carried out. Then, process moves again to step SA2. Accordingly, steps SA2 to SA4 are repeatedly carried out, whereby the musical tone signal corresponding to the keyboard operation is generated in real-time, then the generated musical tone signal is further generated via the sound system 20 as musical tone.

As described heretofore, according to this embodiment, the CPU 5 outputs the level data and rate data as envelope data to the rate register R(n) and level register L(n) respectively. Further, this operation is performed in terms of segments SEG supplying the respective registers in the EG block 12, by means of time-sharing technology. As a result, this embodiment has made it unnecessary to include plural registers corresponding to each segment SEG, so that this embodiment has simplified the circuit requirements of EG block 12, compared with the prior art.

Further, this invention may be practiced or embodied in still other ways without departing from the spirit or essential character thereof. For example, this embodiment adopts the level data and rate data for the envelope data, while any other data may be adopted as the envelope data. Further, this embodiment storing the envelope rate, envelope level and the initial phase data, while these data and information may be changed to any other musical tone control information, etc.

Therefore, the preferred embodiment described herein is illustrative and not restrictive, the scope of the invention being indicated by the appended claims, and all variations which come within the meaning of the claims are intended to be embraced therein.

What is claimed is:

1. An electronic musical instrument comprising:

(a) performance data generating means for generating plural types of performance data;

(b) control means for generating plural types of musical tone control data in accordance with said plural types of performance data, wherein said plural types of musical tone control data including at least first and second musical tone control data; and (c) musical tone signal generating means for generating a musical tone signal corresponding to said musical tone control data, said musical tone signal generating means comprising;

first storing means connected to said control means for storing said first musical tone control data and tone color control data in a time-sharing manner; and second storing means connected to said control means for storing said second musical tone control data;

whereby said musical tone signal generating means generating said musical tone signal in accordance with said first and second musical tone control data.

2. An electronic musical instrument according to claim 1 wherein said musical tone signal generating means generates an envelope signal.

3. An electronic musical instrument according to claim 1 wherein said musical tone control data includes level data representing envelope level of said musical tone signal and rate data representing envelope rate of said musical tone signal.

4. An electronic musical instrument according to claim 1 wherein said performance data generating means includes keyboard means, and said performance data comprises key-on data, key-code data and key-touch data.

5. An electronic musical instrument according to claim 3 wherein said first storing means stores said level data and initial phase data.

6. An electronic musical instrument according to claim 1 wherein said tone color control data includes initial phase data.

7. An electronic musical instrument comprising:

(a) performance data generating means for generating a plurality of performance data;

(b) control means for creating a plurality of types of musical control data according to said plurality of performance data;

(c) a register for storing at least two types of said musical control data in a time-sharing manner;

(d) a selector for supplying said musical control data from said register to a specific output port, wherein said specific output port is selected from a plurality of output ports in accordance with the type of musical control data stored in said register;

(e) a detector for detecting whether or not any of a first type of said musical control data is outputted from said output ports; and (f) musical tone signal generating means for generating a musical tone signal corresponding to said musical control data supplied by said selector, wherein said control means creates a second type of said musical control data upon detection by said detector of said first type of control data.

8. An electronic musical instrument according to claim 7, wherein said at least two types of musical control data comprises initial phase data and level data.

9. An electronic musical instrument according to claim 7, wherein said musical tone signal generating means generates a plurality of channels of musical tones.

* * * * *